United States Patent [19]

Gordon et al.

[11] Patent Number: 4,755,144

[45] Date of Patent: Jul. 5, 1988

[54] STATIC GROUNDING BUCKLE HAVING CONTINUOUS CONTACT

[75] Inventors: Michael E. Gordon, Wayland; Lenard Cohen, Southboro; William Hudspeth, Norwell; Paul Mills, Acton, all of Mass.

[73] Assignee: Plastic Systems, Inc., Marlboro, Mass.

[21] Appl. No.: 43,697

[22] Filed: Apr. 29, 1987

Related U.S. Application Data

[63] Continuation-in-part of Ser. No. 832,846, Feb. 24, 1986, Pat. No. 4,662,695.

[51] Int. Cl.[4] ..... H01R 4/66

[52] U.S. Cl. ..... 439/37; 24/170; 361/212; 361/220; 439/92

[58] Field of Search ..... 439/37, 92; 24/68 A, 24/68 T, 71 R, 71 T, 71 J, 170; 361/212, 220, 223, 224

[56] References Cited

U.S. PATENT DOCUMENTS

| | | | |
|---|---|---|---|
| 1,940,491 | 12/1933 | Freitag | 175/265 |
| 2,588,655 | 3/1952 | O'Neil | 24/71 J |
| 3,596,134 | 7/1971 | Burke | 317/2 B |
| 3,857,397 | 12/1974 | Brosseau | 128/384 |
| 4,373,175 | 2/1983 | Mykkanen | 361/220 |
| 4,398,277 | 8/1983 | Christiansen et al. | 361/220 |
| 4,459,633 | 7/1984 | Vandermark | 361/220 |
| 4,475,141 | 10/1984 | Antonevich | 361/220 |
| 4,577,256 | 3/1986 | Breidegam | 361/212 X |
| 4,639,825 | 1/1987 | Breidegam | 361/212 |

OTHER PUBLICATIONS

Semitronics Descriptive Sheet D5600, Date Unknown.

*Primary Examiner*—Eugene F. Desmond
*Attorney, Agent, or Firm*—Lahive & Cockfield

[57] ABSTRACT

A buckle for securing a conductive strap has a conductive base for skin contact and a non-conductive cover partially attached to the base, the base having upwardly extending sides and the cover downwardly extending sides encapsulating the sides of the base. A conductive attachment element is on the cover and a conductive clip member is within the cover in electrical conduct with the attachment means and with the base continuously when the cover is closed and open.

9 Claims, 2 Drawing Sheets

STATIC GROUNDING BUCKLE HAVING CONTINUOUS CONTACT

BACKGROUND

This application is a continuation-in-part of application Ser. No. 832,846, filed Feb. 29, 1986, now U.S. Pat. No. 4,662,695.

This invention relates to buckles for static-conductive straps or cuffs.

Some buckles on static-conductive straps are made entirely of metal to provide a complete electrical circuit between the body of the wearer and the grounding means, usually a cord that is attached to the buckle at one end and a grounding point at the other. Some metal buckles open and close to permit adjustment of the diameter of the wrist strap. Other buckles are made of non-conductive material that encloses conductive portions, and a portion of which may be opened to permit adjustment of the length of the strap which adjustment requires trimming of the tail end of the strap.

The following U.S. patents disclose various wrist grounding devices: Brosseau U.S. Pat. No. 3,857,397; Mykkanen U.S. Pat. No. 4,373,175; Christiansen et al. U.S. Pat. No. 4,398,277; Vandermark U.S. Pat. No. 4,459,633; Antonevich U.S. Pat. No. 4,475,141, and Breidegam U.S. Pat. No. 4,577,256. Body and leg groundling devices are also known: Freitag U.S. Pat. No. 1,940,491; and Burke U.S. Pat. No. 3,596,134.

It is an object of the present invention to provide a buckle for a static-conductive wrist band that will permit both lengthening and shortening of the wrist strap without necessarily requiring trimming and, at the same time, will not cause accidental electrostatic discharge when it comes in contact with, e.g., electronic parts, or electric shock to the wearer in case of inadvertent contact with live electrical circuits. It is a further object to provide such a buckle which provides grounding contact regardless of whether the wrist band buckle is fully closed.

Other objects of the invention will in part be obvious and will in part appear hereinafter.

DESCRIPTION OF PREFERRED EMBODIMENT

Drawings

For a fuller understanding of the nature and objects of the invention, reference should be made to the following detailed description, and the accompanying drawings, in which.

Structure

Figure 1:
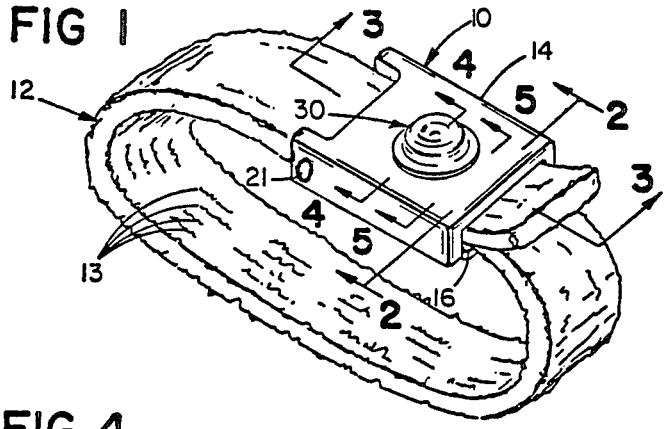
FIG. 1 is an isometric view of buckle for a static-conductive strap, also shown.

Referring to FIG. 1, a buckle 10 for a static conductive strap 12 has an electrically insulating cover 14 made of, e.g., non-conductive nylon, having a surface resistivity in a particular embodiment of from $10^{12}$ to $10^{14}$ ohms per square, and (as more clearly shown in FIGS. 2–7) an electrically conductive metal, e.g., stainless steel, base 16. Strap 12 is a length of woven elasticized nylon that is non-conductive on its outer surface and that has, on its inner surface, interwoven electrically conducting threads 13 made of, e.g., stainless steel fibers or silver-impregnated nylon (e.g., "X-Static" thread manufactured by Sauquoit Industries, Scranton, Pa.). Cover 14 and base 16 are attached to each other in a hinged relationship by hinge rivet pins 18, 20 (FIGS. 1, 3, 6, 7), the heads 19, 21 of which are recessed in counter bores 22, 24.

Base 16 has upwardly extending side walls 23, 25; and cover 14 has downwardly extending sides 26, 28 that entirely enclose side walls 23, 25 when buckle 10 is in its closed position (FIG. 1).

Cover 14 has a conductive metal snap stud 30 inserted through cover hole 32 (FIG. 3), and through metal closure clip 34 such that cover 14 and closure clip 34 are closely held between stud top 36 and stud base 38 of snap stud 30, with closure clip 34 in electrically conductive contact with stud base 38.

Figure 4:
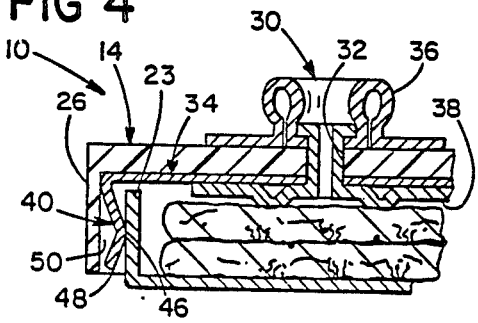
FIG. 4 is a sectional view, partially broken away, of the buckle taken along the line 4—4 of FIG. 1.
Figure 6:
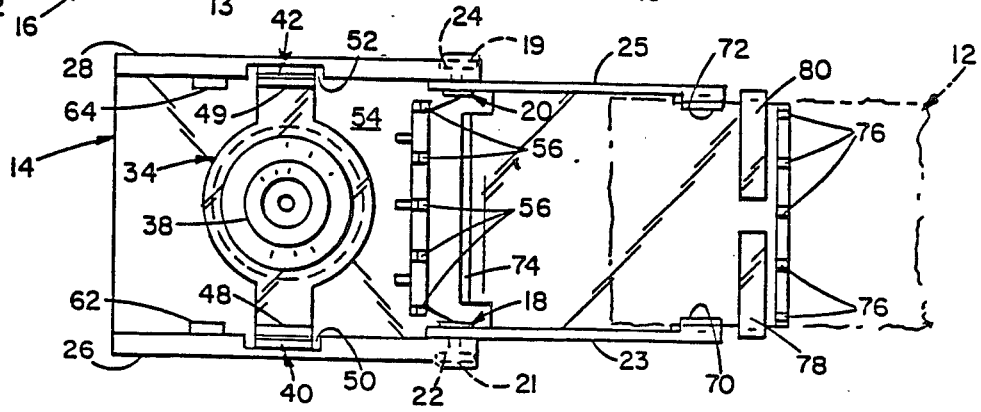
FIG. 6 is a top view of the buckle, opened.

Closure clip 34 has downwardly projecting tabs 40, 42 each of which has (as shown in FIG. 4) an inward bend and a reverse bend so as to form contact knuckles 46, 47 for resiliently engagingly side walls 23, 25 and closure guides 48, 49. As shown in Figs. 4 and 6, each of tabs 40, 42 is recessed into pockets 50, 52 in sides 26, 28.

Figure 5:
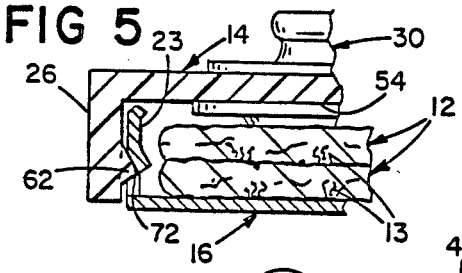
FIG. 5 is a sectional view, partly broken away, of the buckle taken along the line 5—5 of FIG. 1.
Figure 3:
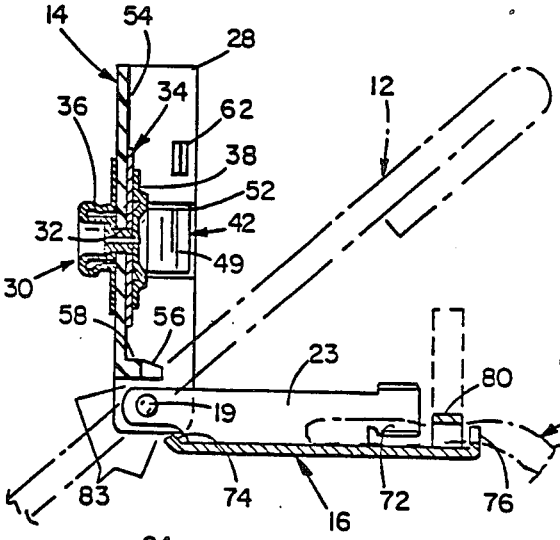
FIG. 3 is a sectional view of the buckle in an open position taken along the line 3—3 of FIG. 1.

Referring to FIGS. 3 and 4, the inner surface 54 of cover 14 has a row of downwardly projecting teeth 56 integral with tooth base 58, which is perpendicular to inner surface 54. As shown in FIG. 3, teeth 56 and base 16 cooperate to form gap 83 between them, through which an end of strap 12 is inserted. As shown in FIGS. 3, 5, and 6, cover 14 also has locking lugs 62, 64 on the inner surfaces 66, 68 of sides 26, 28, spaced the same distance from hinge rivet pins 18, 20 as are closure recesses 70, 72 in base 16, such that lugs 62, 64 snap into locking relationship with closure recesses 70, 72 when buckle 10 is closed.

Figure 7:
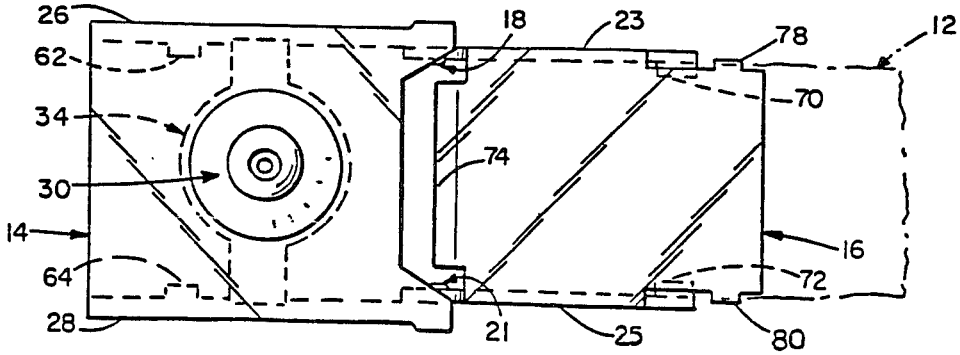
FIG. 7 is a bottom view of the buckle, opened.

As shown in FIGS. 3, 6, and 7, base 16 has, adjacent hinge pins 18, 20, tail portion 74 that is bent upward from base 16 at an angle of approximately 45°. At the end opposite the hinged end of base 16 is a row of strap anchoring teeth 76 perpendicular to, and integral with base 16. As shown in FIGS. 3 and 4, strap anchoring tabs 78, 80 are integral with base 16, are spaced slightly from anchoring teeth 76, and fold inward transversely over an end of strap 12, thereby holding conductive threads 13 in electrically conductive contact with anchoring teeth 76.

Operation

Figure 2:
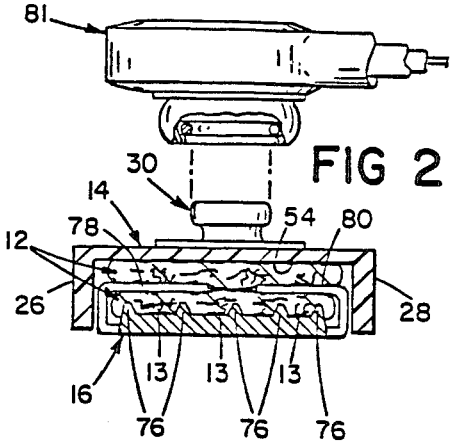
FIG. 2 is a sectional view of the buckle taken along the line 2—2 of FIG. 1 and also illustrating a portion of a grounding cord adapted for connection to the buckle.

In operation, buckle 10 is opened to pull more or less of strap 12 through gap 83, depending upon the size of the wrist and the snugness of fit desired. Cover 14 is then snapped closed, and the end 81 of a suitable grounding cord, as shown in Fig. 2, having a mating snap for connection to snap stud 30 is attached both to snap stud 30 and, at its other end, to an appropriate grounding means (not shown).

The closing of cover 14 brings contact knuckles 46, 47 into contact side walls 23, 25 thereby providing both a complete electrical path from base 16 to snap stud 30, and friction to keep cover 14 closed in addition to the closure friction provided by the interlock of lugs 62, 64 with closure recesses 70, 72. This electrical path is protected from contact with, e.g., workbench equipment or workpieces, by virtue of its being enclosed within non-conductive cover 14. In fact, all conductive portions of buckle 10 when in use are insulated from contact with anything other than the worker's wrist, thereby minimizing the possibility both of a potentially damaging electrostatic discharge event, and of an electrical injury to the worker caused by inadvertent contact with an unprotected electrical circuit.

Static electricity is drained from the worker's body via the electrical circuit provided by conductive threads 13 electrically connected to base 16 by anchoring teeth 76 and/or by the contact of the base itself with the worker's body. Moreover, conductive threads 13 are only on the inner surface of strap 12, insulated from contact with anything other than the worker's wrist and base 16.

When cover 14 is closed, teeth 56 dig into the fabric of strap 12, which is thereby tightly held between teeth 56 and base 16. Tail portion 74 provides additional friction to prevent strap 12 from being pulled from buckle 10. Pulling backward on strap 12 against teeth 56 has the effect of holding cover 14 closed.

Alternate Embodiment

FIGS. 8–11 depict a second embodiment of buckle 10' which maintains electrical contact between stud base 38' and buckle base 16' regardless of whether the cover 14' is closed or open. The features of the alternative embodiment are generally the same as those described above for FIGS. 1–7; primed numbers corresponding to the numbers used above are used to describe the features in FIGS. 8–10.

Figure 8:
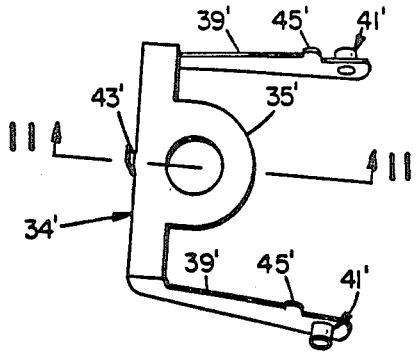
FIG. 8 is a top view of a conductive clip used in an alternate embodiment of the buckle.
Figure 9:
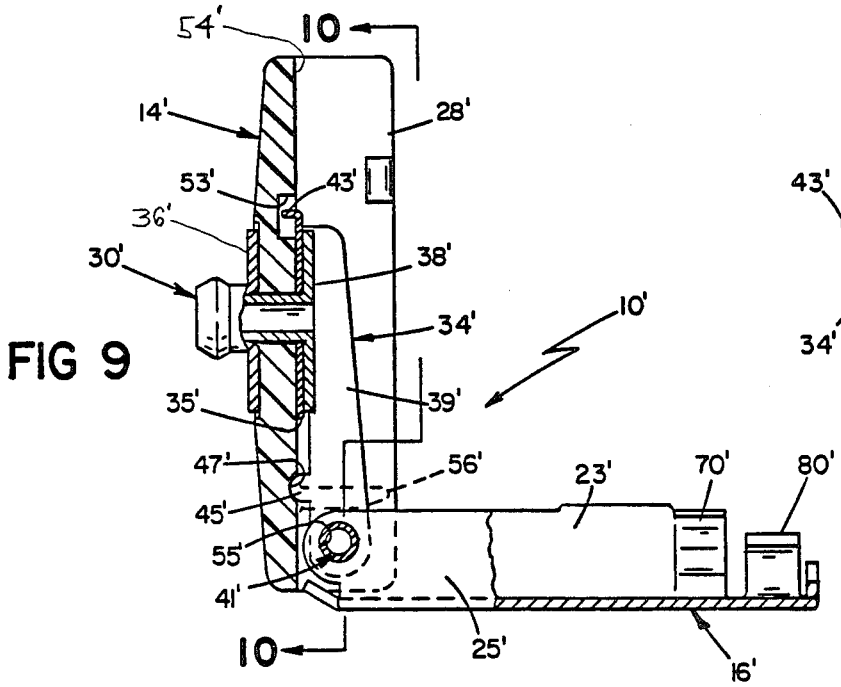
FIG. 9 is a side sectional view partly broken away of a buckle using the clip of FIG. 8 taken along line 9—9 of FIG. 10.
Figure 11:
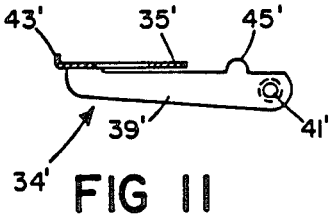
FIG. 11 is a view taken along line 11—11 of FIG. 8.
Figure 10:
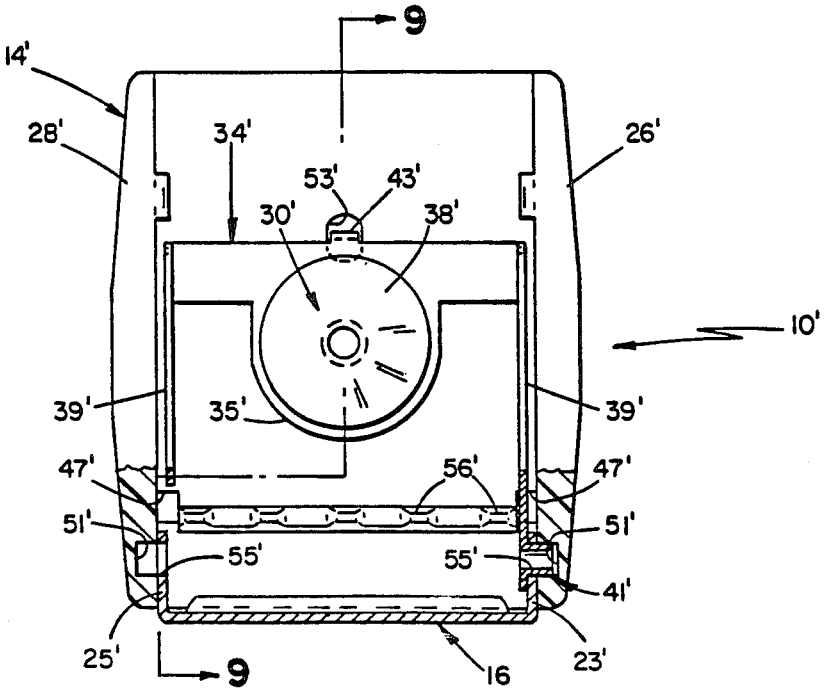
FIG. 10 is a view, partly broken away, taken along line 10—10 of FIG. 9.

In the illustrated buckle 10' of FIGS. 8–10, the strap (not shown), cover 14', stud 30', and base 16' can be the same as corresponding features in FIGS. 1–7, except that the cover 14' preferably interfits with the closure clip 34' and the cover and the base 16' are hinged together by way of the chip 34', as now described.

Closure clip 34' is a conductive metal clip having an horizontal annular segment 35' through which stud 30' is inserted to hold the cover 14' and the clip 34' closely together between stud top 36' and stud base 38'.

Clip 34' has two elongated and coextensive spring arms 39' positioned to extend along the inside of cover sides 26' and 28' toward the hinge connection between cover 14' and base 16'. The arms extend side by side, on either side of the annular segment 35'. At the end of each arm 39' furthest from stud 30' is an outwardly projecting cylindrical metal hinge pin 41'. The two hinge pins extend in opposite, outward directions and are axially aligned; the axis is parallel to the plane of the annular segment 35' and to the spacing between the arms, all as shown in FIG. 8.

As shown best in FIG. 10, in which the left arm of clip 34' broken away, each pin 41' is sized to fit tightly through a hole 55' in side walls 23' and 25' of base 16', and into a hole 51' in plastic cover 14'.

To assemble buckle 10', arms 39' are resiliently retained inwardly to allow pins 41' to clear the base. When the cover and base are properly positioned, the spring arms are released and the arms resiliently bias the pins 41' in place. A locating tang 43' on clip 34' extends upwardly into a central recess 53' in cover 14' inner surface 54'. Locating knobs 45' extend upwardly on arms 41' to fit within co-operating recesses 47' in cover 14' inner surface 54', for positioning clip 34' when the buckle 10' is being assembled.

The structure of clip 34' provides a continuous electrical pathway between stud 30' and base 16', regardless of whether buckle 10' is open or closed. In this way, static build-up is continuously avoided, e.g., when the user forgets or fails to close the buckle completely. This electrical connection between the clip 34' and the base 16' is provided by contact between the arms 39' and the hinge pins 41' of the clip 34' and the sides 23' and 25' of the cover 16'. Further, the clip 34' provides the hinge connection between the cover 14' and the base 16'. As a result, the buckle 10' of FIGS. 8–11 does not employ the hinge pins 18 and 20, or the counter bores 22 and 24, of the buckle 10 of FIGS. 1–7.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also understood that the following claims are intended to cover all of the generic and specific features of the invention herein described, and all statements of the scope of the invention which, as a matter of language, might be said to fall therebetween.

Having described the invention, what is claimed as new and secured by Letters Patent is:

1. A buckle for a static-conductive body strap characterized by a conductive base for contact with the body of the wearer, said base having two sides extending upwardly, a cover of insulating material hingedly attached to said base for movement relative thereto between open and closed positions, said cover having sides extending downwardly outside the sides of said base, electrically conductive attachment means attached to said cover for connection with electrical grounding means, and a conductive member attached to and within said cover in continuous electrical contact with said attachment means and with said base in both said open position and said closed position.

2. A buckle according to claim 1, further characterized in that said conductive member includes conductive means hingedly engaging said base and providing electrical contact therewith.

3. A buckle according to claim 1 further characterized in that said buckle comprises hinge means joining said base to said cover, and said conductive member comprises an elongated conductor, extending inside of said cover, and making electrical contact between said conductive attachment means and said hinge means.

4. A buckle according to claim 1 further characterized in that said conductive member comprises a pair of resilient biasing extensions, cooperatively engaging said hinge means.

5. A buckle according to claim 3 wherein said hinge means comprises conductive tubular shaft means carried on said conductive member and engaging an opening in said conductive base.

6. Buckle apparatus for a static-conductive body strap and having a conductive base for contact with the body of a wearer, a cover of insulating material hingedly attached to said base for movement relative thereto between open and closed positions, and electrically conductive attachment means attached to said cover for connection with electrical grounding means, and further having the improvement comprising a conductive member attached to and within said cover in electrical contact with said attachment means and having first and second hinge pin means axially aligned and projecting therefrom for providing said hinged attachment of said cover with said base.

7. Buckle apparatus according to claim 6, having the further improvement wherein said conductive member further includes means mounting said hinge pin means for resilient axial deflection.

8. Buckle apparatus according to claim 6, having the further improvement in which said conductive member further includes locating projections arranged for seating engagement relative to said cover for locating said conductive member relative thereto.

9. A buckle according to claim 1, further characterized in that said conductive member includes a projecting locating tang that locatingly co-operatively engages a locating recess in said cover.

* * * * *